United States Patent [19]

Papageorges et al.

[11] Patent Number: 4,459,174

[45] Date of Patent: Jul. 10, 1984

[54] PROCESS FOR THE DELIGNIFICATION AND BLEACHING OF CHEMICAL AND SEMI-CHEMICAL CELLULOSIC PULPS

[75] Inventors: Georges Papageorges, Rixensart; Pierre Ledoux, Brussels, both of Belgium

[73] Assignee: Interbox (Societe Anonyme), Brussels, Belgium

[21] Appl. No.: 400,380

[22] Filed: Jul. 21, 1982

Related U.S. Application Data

[63] Continuation of Ser. No. 152,676, May 23, 1980, abandoned.

[30] Foreign Application Priority Data

May 25, 1979 [FR] France ..... 79 13554

[51] Int. Cl.[3] ..... D21C 9/12; D21C 9/16

[52] U.S. Cl. ..... 162/40; 162/60; 162/65; 162/76; 162/78; 162/89

[58] Field of Search ..... 162/30 K, 30 R, 65, 162/78, 90, 40, 41, 76, 19, 89

[56] References Cited

U.S. PATENT DOCUMENTS

| | | | |
|---|---|---|---|
| 3,719,552 | 3/1973 | Farley | 162/78 |
| 4,196,043 | 4/1980 | Singh | 162/65 |
| 4,372,812 | 2/1983 | Phillips et al. | 162/78 |

OTHER PUBLICATIONS

"Pulping Processes", Rydholm, Interscience Publishing, N.Y., 1967, pp. 1118–1121.

Soteland, "Bleaching of Chemical Pulps with Oxygen and Ozone", *Pulp and Paper Mag. of Canada,* vol. 75, No. 4, pp. 91–96, (1974).

*Primary Examiner*—Steve Alvo

*Attorney, Agent, or Firm*—Spencer & Frank

[57] ABSTRACT

A process for the delignification and bleaching of chemical and semi-chemical cellulosic pulps in which the pulp is subjected to a treatment with oxygen and a subsequent treatment with peroxide. The effluent from the treatment with peroxide is at least partially recycled to the treatment with oxygen.

12 Claims, No Drawings

PROCESS FOR THE DELIGNIFICATION AND BLEACHING OF CHEMICAL AND SEMI-CHEMICAL CELLULOSIC PULPS

CROSS REFERENCE TO RELATED APPLICATION

This application is a continuation application of applicants' copending U.S. application Ser. No. 152,676 filed May 23, 1980, now abandoned.

BACKGROUND OF THE INVENTION

The present invention relates to a stepwise process for the delignification and bleaching of chemical and semi-chemical cellulosic pulps by the action of oxygen, which additionally comprises a subsequent bleaching treatment with peroxide.

The bleaching of chemical and semi-chemical cellulosic pulps intended in particular for the manufacture of paper, in general requires several successive bleaching treatments, optionally with the interposition of washing, dilution and/or concentration stages, in order to arrive at the desired residual lignin content and the desired whiteness.

Various types of bleaching agents are commonly used for the treatment of cellulosic pulps. Thus it has been proposed to subject chemical and semi-chemical pulps to the action of oxygen or of air in an alkaline medium and then to bleaching treatments comprising a treatment with peroxide. However, the removal of the lignin, and the increase in whiteness, are accompanied by substantial changes in the physical characteristics of the cellulosic pulps and more particularly by a significant reduction in the viscosity of the pulps, revealing a depolymerisation of the cellulose chains. Operated on an industrial scale, the yield of the processes is low. Furthermore, the strength of the final products is diminished.

SUMMARY OF THE INVENTION

The object of the invention is to provide a process which makes it possible to overcome the disadvantages of the abovementioned known processes and in particular to avoid an excessive depolymerisation of the cellulose in the chemical and semi-chemical pulps.

The process according to the invention furthermore makes it possible to produce paper pulps with good yields. The pulps obtained additionally have a good degree of whiteness.

To achieve these objects, the invention provides a process for the delignification and bleaching of chemical and semi-chemical cellulosic pulps comprising a treatment with oxygen in an alkaline medium and a subsequent treatment with peroxides, wherein the effluents from the treatment with peroxide are recycled at least partially to the treatment with oxygen.

DETAILED DESCRIPTION OF THE INVENTION

In general, only a part of the effluents from the treatment with peroxide, preferably not exceeding 80% of their weight, is recycled to the treatment with oxygen (hereafter also referred to as stage O). Good results have been obtained by recycling from 5 to 70% by weight of the effluents of the treatment with peroxide (hereafter also referred to as stage P) to the treatment with oxygen.

The treatment with oxygen is in general carried out by means of a gas containing oxygen, such as oxygen itself or air. Other gas mixtures containing oxygen can also be used. The partial pressures of oxygen can vary within wide limits. They are in general between 100 kPa and 2 MPa. The temperatures are in general between 353° and 423° K. and preferably between 373° and 503° K.

The treatment with oxygen is carried out in the presence of an aqueous alkaline solution. Various types of alkalis can be used for this purpose. In general, they are selected from among alkali metal and ammonium hydroxides, bicarbonates and carbonates, and mixtures of these. Good results have been obtained by employing an alkali containing sodium hydroxide. The amount of alkali employed can vary within wide limits. It is in general between 0.1 and 20% and preferably between 1 and 15% of the weight of the dry pulp.

The consistency of the pulp employed in stage O is in general between 3 and 50% and preferably between 5 and 40%.

Various additives can be employed in stage O, such as protective agents for the cellulose, sequestering agents, pH regulators and the like, without such use being indispensable. The total content of various additives in general does not exceed 10% by weight of the dry pulp.

The protective agents are in general selected from among the derivatives of alkaline earth metals. These derivatives are most commonly salts of alkaline earth metals and more particularly magnesium salts. Thus, during the treatment with oxygen, magnesium carbonate, sulphate, oxide or hydroxide may be employed.

The treatment with oxygen can be carried out in any apparatus which is in itself known and is suitable for the delignification process and capable of withstanding the pressures employed. Thus, various types of autoclaves may be used.

After the treatment with oxygen, the pulp is degassed. It can be fed, as obtained, to the subsequent bleaching treatment. It is also possible to subject the pulp to one or more washing or dilution stages, with or without concentration stages, before feeding it to the subsequent bleaching treatment. These various stages can be carried out in various types of apparatus which are in the art. Thus, the concentration operations can be carried out in various types of apparatus which permit draining the pulp, such as rotary filters or various types of presses. Any effluents from these washing, dilution and concentration stages subsequent to stage O can be recycled to stage O and/or be incinerated so as to regenerate the alkali. In general, at least 10% by weight of these effluents is fed to recuperation boilers, in order to be incinderated therein.

Optionally, the pulp obtained can subsequently be subjected to intermediate bleaching treatments, before being fed to the treatment with peroxide. Thus, the pulp resulting from stage O can, where appropriate after the abovementioned washing, dilution or concentration stages, be subjected to at least one intermediate treatment selected from among the treatments with percarboxylic acids and with ozone. Such intermediate bleaching treatments are, however, not indispensable. Good results have been obtained by feeding the pulp resulting from the treatment with oxygen to the treatment with peroxide without an intermediate bleaching treatment.

The treatment with peroxide is carried out in the presence of peroxidic compounds of various types.

Thus, it is possible to use hydrogen peroxide, alkali metal peroxides, other inorganic peroxides, and organic peroxides, hydroperoxides or peracids. In general, a peroxidic compound selected from among hydrogen peroxide, sodium peroxide and mixtures of these is used. Good results are obtained by using hydrogen peroxide. The amount of peroxidic compounds employed, calculated as pure hydrogen peroxide, is in general between 0.1 and 10% and preferably between 0.2 and 5% by weight of the dry pulp.

The mixture subjected to stage P is maintained at a basic pH, in general between 9 and 13 and most commonly between 10 and 12.5. To do this, alkalis, which can be of very diverse types, are added to the mixture. In general, alkali metal, alkaline earth metal or ammonium hydroxides or carbonates, and more particularly sodium hydroxide, are added to the mixture. The amount of alkali employed depends on the type of peroxidic compound employed and more particularly on its ultimate alkaline character. Where the peroxidic compound is hydrogen peroxide, in general from 0.2 to 15% by weight of alkali relative to the weight of dry pulp is added. Good results are obtained by using from 0.5 to 10% of alkali. These amounts are less if the peroxidic compound contains sodium peroxide.

The consistencies of the pulps subjected to the treatment with peroxide are in general between 2 and 25%. The temperatures are in general between ambient temperature and the boiling point of the mixture. Good results are obtained at temperatures of between 333° and 353° K.

Various additives, such as organic or inorganic stabilisers, surfactants, complexing agents, pH regulators and the like, can be employed in stage O, without this being indispensable.

The stabilisers used are in general compounds selected from among magnesium salts, such as magnesium sulphate, and the silicates, such as waterglass.

The complexing agents employed are in general agents selected from among organic compounds containing nitrogen and/or phosphorus, such as nitrilotriacetic acid, ethylenediaminetetraacetic acid, diethylenetriaminepentaacetic acid and their salts, polyhydroxycarboxylic acids and their salts, such as sodium polyalpha-hydroxyacrylate, and hydroxycarboxylic acids and their salts, such as sodium gluconate.

The treatment with peroxide can be carried out in various apparatus which are in themselves known, such as towers or beaters.

The pulp resulting from the treatment with peroxide is then subjected to one or more concentration stages, where appropriate, after one or more prior dilutions.

Concentration may be effected in accordance with various techniques which are in themselves known, such as draining on a rotary filter or in various types of presses. This concentration process brings the pulp to a consistency which is in general greater than 10%.

The effluents originating from the concentration stages following the treatment with peroxide are at least partly recycled to stage O according to the invention. They can be recycled directly into the apparatus in which the treatment with oxygen is carried out, or be mixed with the effluents from stage O which are intended to be recycled to this apparatus.

The part of the effluents from stage P which is not recycled to stage O is advantageously recycled to stage P or is used to dilute the pulp, resulting from stage P, before the pulp is concentrated.

A particularly satisfactory process consists of diluting the pulp, resulting from the treatment with peroxide, concentrating it on one or more apparatuses suitable for drainage, collecting the effluents from these drainage operations, which constitute the effluents of the process according to the invention, using from 30 to 95% of these effluents for the stage of dilution of the pulp resulting from the treatment with peroxide, and recycling the remainder of these effluents to the treatment with oxygen.

The various types of apparatus used for the draining of the pulp resulting from the treatment with peroxide can also be fed with a small amount of fresh water or of an aqueous solution. In this case, the amount of water or aqueous solution employed is substantially equal to the amount of effluents from the treatment with oxygen which is fed to the recuperation boilers.

Depending on the degree of whiteness desired, stage P of the process according to the invention can include one or more supplementary bleaching treatments. These are in general selected from among treatments with peroxide, with chlorine dioxide (also referred to as stages D), with hypochlorite (also referred to as stages H), with percarboxylic acids (also referred to as stage $P_A$), and with chlorine (also referred to as stages C), or alkaline extraction treatments (also referred to as stage E). Certain particular sequences of subsequent treatments have given good results; these are the sequences CED, CEH, CHH, CPD, CPH, DED, DHD and DPD.

A practical example of an embodiment is given below in order to illustrate the invention without however limiting its scope. Example 2 was carried out by way of comparison, in the absence of recycling.

EXAMPLE 1

Bleaching of a pine kraft pulp

A pine kraft pulp (initial whiteness 27.6° ISO, kappa index 39.6) was subjected to a five-stage treatment comprising a first treatment with oxygen and a second treatment with peroxide, with recycling of the effluent from the peroxide stage to the oxygen stage. The working conditions are shown below. The percentages of the reactants are quoted relative to the dry pulp.

1st stage reactants:
$O_2$, 800 kPa
NaOH, 4%
$MgSO_4.7H_2O$, 0.5%
temperature: 393° K.
pulp consistency: 15%
duration: 1 hour 2nd stage reactants:
$H_2O_2$, 0.8%
NaOH, 1.5%
sodium poly-alpha-hydroxyacrylate, 1.0%
temperature: 343° K.
pulp consistency: 12%
duration: 2 hours 3rd stage reactants: $ClO_2$, 2.0% of active chlorine
temperature: 343° K.
pulp consistency: 10%
duration: 3 hours 4th stage reactant: NaOH, 1.5%
temperature: 333° K.
pulp consistency: 10%
duration: 2 hours 5th stage reactant: $ClO_2$, 1.5% of active chlorine
temperature: 343° K.
pulp consistency: 10%
duration: 2 hours The final viscosity of the pulp resulting from the last stage, when measured in accordance with Standard Specification TAPPI T 230, is 12.0 mPa.s.

EXAMPLE 2

Bleaching of a pine kraft pulp

The same pine kraft pulp as that used for carrying out experiment 1 was subjected to a five-stage treatment comprising a first treatment with oxygen and a second treatment with peroxide, without recycling of the effluent from the peroxide stage to the oxygen stage. The other working conditions are identical to those of experiment 1.

The final viscosity of the pulp leaving the last stage is 10.8 mPa.s. Hence, the cellulosic pulp has undergone a greater depolymerisation than when using the process according to the invention.

What is claimed is:

1. In a process for the delignification and bleaching of at least one cellulosic pulp selected from the group consisting of chemical cellulosic pulps and semi-chemical cellulosic pulps in which the pulp is subjected to a treatment with oxygen in an alkaline medium and a subsequent treatment with peroxide, the improvement comprising:

(a) subjecting the pulp to the treatment with oxygen in the alkaline medium and then to the treatment with peroxide at a basic pH without immediate treatment, and (b) recycling between 5 and 70% by weight of the effluents resulting from the treatment with peroxide to the treatment with oxygen to avoid an excess depolymerization of cellulose.

2. In a process for the delignification and bleaching of at least one cellulosic pulp selected from the group consisting of chemical cellulosic pulps and semi-chemical cellulosic pulps in which the pulp is subjected to a treatment with oxygen in an alkaline medium and a subsequent treatment with peroxide at a basic pH, the treatment comprising:

(a) subjecting the pulp to at least one intermediate treatment selected from among washings, concentrations, dilutions, a bleaching treatment with a carboxylic peracid, and a bleaching treatment with ozone, after the pulp is subjected to the treatment with oxygen in alkaline medium and before it is subject to the treatment with peroxide, and (b) recycling between 5 and 70% by weight of the effluents resulting from the treatment with peroxide to the treatment with oxygen to avoid an excess depolymerization of cellulose.

3. Process according to claim 1 or 2, wherein the treatment with oxygen is carried out under a partial oxygen pressure of between 200 kPa and 2 MPa.

4. Process according to claim 1 or 2, wherein the oxygen treatment is carried out in the presence of from 1 to 15% of an alkali, relative to the weight of the dry pulp.

5. Process according to claim 1 or 2, wherein the alkaline medium comprises sodium hydroxide.

6. Process according to claims 1 or 2, wherein the treatment with oxygen is carried out on a pulp having a consistency of between 5 and 40%.

7. Process according to claim 1 or 2, wherein the treatment with peroxide is carried out with from 0.2 to 5% of a peroxidic compound calculated as 100% strength hydrogen peroxide.

8. Process according to claim 1 or 2, wherein the peroxide employed in the treatment with peroxide is selected from the group consisting of sodium peroxide, hydrogen peroxide, and mixtures thereof.

9. Process according to claim 1 or 2, wherein during the treatment with peroxide, the pH of the treatment is maintained at a value between 9 and 13.

10. Process according to claim 1 or 2, wherein the treatment with peroxide is carried out on pulp having a consistency of between 2 and 25%.

11. Process according to claim 1 or 2 in which the pulp is subjected after the peroxide treatment of step (b) to at least one final treatment selected from among the treatments with peroxide, with chlorine dioxide, with hypochlorite, with carboxylic peracids, with chlorine, and alkaline extractions.

12. Process according to claim 1 or 2 in which the pulp is subjected to the treatment with oxygen under a pressure of between 200 kPa and 2 MPa in an alkaline medium at a temperature of between 353° and 423° K.

* * * * *

UNITED STATES PATENT AND TRADEMARK OFFICE

CERTIFICATE OF CORRECTION

PATENT NO. : 4,459,174

DATED : July 10, 1984

INVENTOR(S) : Georges Papageorges et al

It is certified that error appears in the above-identified patent and that said Letters Patent is hereby corrected as shown below:

Title page, under [73] the Assignee's name should read --Interox (Societe Anonyme)--.

Signed and Sealed this

*Nineteenth* Day of *March 1985*

[SEAL]

*Attest:*

DONALD J. QUIGG

*Attesting Officer*

*Acting Commissioner of Patents and Trademarks*